US010148050B2

(12) United States Patent
Ma et al.

(10) Patent No.: US 10,148,050 B2
(45) Date of Patent: Dec. 4, 2018

(54) CABLE CONNECTOR ASSEMBLY TRANSFERRING DIFFERENT VOLTAGES

(71) Applicant: FOXCONN INTERCONNECT TECHNOLOGY LIMITED, Grand Cayman (KY)

(72) Inventors: Guang-Yu Ma, Kunshan (CN); Dou-Feng Wu, Kunshan (CN); Xiao-Li Li, Kunshan (CN); Chien-Hsun Huang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/249,728

(22) Filed: Aug. 29, 2016

(65) Prior Publication Data

US 2017/0062998 A1 Mar. 2, 2017

(30) Foreign Application Priority Data

Aug. 28, 2015 (CN) ..... 2015 1 0537668

(51) Int. Cl.
*H01R 13/717* (2006.01)
*H01R 31/06* (2006.01)
(Continued)

(52) U.S. Cl.
CPC ..... *H01R 31/065* (2013.01); *H01R 13/6658* (2013.01); *H01R 13/6683* (2013.01); *H01R 24/62* (2013.01); *H01R 2107/00* (2013.01)

(58) Field of Classification Search
CPC ..... H01R 13/7175; H01R 13/6658; H01R 13/7172; H01R 13/717; H01R 13/6691;
(Continued)

(56) References Cited

U.S. PATENT DOCUMENTS 5,157,769 A * 10/1992 Eppley ..... G06F 1/26 327/321
6,165,006 A * 12/2000 Yeh ..... H01R 13/6641 439/490

(Continued)

FOREIGN PATENT DOCUMENTS

CN 2472370 1/2002
CN 1846334 10/2006

(Continued)

*Primary Examiner* — James Harvey
*Assistant Examiner* — Matthew T Dzierzynski
(74) *Attorney, Agent, or Firm* — Wei Te Chung; Ming Chieh Chang

(57) ABSTRACT

A cable connector assembly including: a first electrical connector comprising a frontal first mating member for inputting a first voltage, a first voltage point for outputting the first voltage, and a second voltage point for outputting a second voltage different from the first voltage; a second electrical connector comprising a frontal second mating member and a second printed circuit board, the second mating member comprising a power contact; and a cable connecting the first electrical connector and the second electrical connector electrically, the cable comprising a first wire and a second wire, the first wire connecting the first voltage point and the power contact electrically, the second wire connecting the second voltage point and the second printed circuit board electrically.

18 Claims, 12 Drawing Sheets

(51) Int. Cl.
*H01R 13/66* (2006.01)
*H01R 24/62* (2011.01)
*H01R 107/00* (2006.01)

(58) Field of Classification Search
CPC .... H01R 31/065; H01R 24/62; H01R 13/631; H01R 13/6641; H01R 13/70; H01R 13/6683; H01R 13/701; H01R 2107/00; H01R 13/652; H01R 13/6585; H01R 13/6592; H01R 13/7177; H01R 2105/00; H01R 24/20; H01R 24/22; H01R 24/60; H01R 24/70; H01R 25/003; H01R 27/02; H01R 31/06; H01R 43/0207; H01R 9/034
USPC ..... 439/490, 488, 56, 607.46, 620.22
See application file for complete search history.

(56) References Cited

U.S. PATENT DOCUMENTS 6,860,762 B2 * 3/2005 Spykerman ..... G11B 33/122 363/142
7,544,909 B2 * 6/2009 Dhir ..... H01R 13/7175 200/51.11
7,744,231 B2 6/2010 Hutchinson et al.
7,976,336 B2 * 7/2011 Yang ..... H01R 13/6658 439/490
8,475,203 B2 * 7/2013 Wu ..... H01R 13/6658 439/490
8,740,640 B2 6/2014 Hardy
9,022,605 B2 * 5/2015 Bushnell ..... H01R 13/631 320/107
9,028,122 B2 * 5/2015 Tuchrelo ..... H01R 13/7175 362/253
9,160,119 B2 * 10/2015 Hardy ..... H01R 13/7175
9,559,534 B2 * 1/2017 Lee ..... H01R 13/70
9,570,864 B1 * 2/2017 Moyer ..... H01R 13/7175
2003/0194906 A1 * 10/2003 Arkin ..... H01R 13/717 439/490
2005/0260884 A1 * 11/2005 Yueh ..... H01R 13/6691 439/488
2006/0039136 A1 * 2/2006 Probasco ..... H01R 13/652 362/157
2012/0289080 A1 * 11/2012 Huang ..... H01R 13/6658 439/502
2013/0065444 A1 3/2013 Bushnell
2013/0308304 A1 11/2013 Tuchrelo et al.
2017/0047695 A1 * 2/2017 Ma ..... H01R 13/717

FOREIGN PATENT DOCUMENTS

CN 201829747 5/2011
CN 203660206 6/2014
CN 204030207 12/2014
CN 204243389 4/2015
TW I371141 8/2012
TW M485567 9/2014

* cited by examiner

CABLE CONNECTOR ASSEMBLY TRANSFERRING DIFFERENT VOLTAGES

BACKGROUND OF THE INVENTION

1. Field of the Invention

The present invention relates generally to a cable connector assembly, and more particularly to a cable connector assembly transferring different voltages.

2. Description of Related Arts

U.S. Pat. No. 8,740,640, issued on Jun. 3, 2014, discloses an electrical connector including an LED and an electrical circuitry (e.g., implemented by a variable capacitance switch) to automatically energize the LED by a user's mere touching of an overmold thereof at its flat or bottom side without otherwise manually operating a control switch. A constant voltage is derived from power source and is applied across a variable and touch-sensitive capacitor and resistors to ground.

U.S. Patent Application Publication No. 2013/0065444, published on Mar. 14, 2013, discloses a charging connection device comprising: a device connector; an internal printed circuit board coupled to the connector and including charging circuitry and an associated light source thereon; a housing enclosing the circuit board and including a first end comprising a light guide or lens, the connector extending from the first end; a touch-type switch carried by the housing, coupled to the circuit board, and configured to activate the light source; and a power source connector coupled to the circuit board and associated with a second end of the housing.

SUMMARY OF THE INVENTION

An object of the present invention is to provide a cable connector assembly transferring different voltages.

To achieve the above-mentioned object, a cable connector assembly includes: a first electrical connector comprising a frontal first mating member for inputting a first voltage, a first voltage point for outputting the first voltage, and a second voltage point for outputting a second voltage different from the first voltage; a second electrical connector comprising a frontal second mating member and a second printed circuit board, the second mating member comprising a power contact; and a cable connecting the first electrical connector and the second electrical connector electrically, the cable comprising a first wire and a second wire, the first wire connecting the first voltage point and the power contact electrically, the second wire connecting the second voltage point and the second printed circuit board electrically.

Other objects, advantages and novel features of the invention will become more apparent from the following detailed description when taken in conjunction with the accompanying drawings.

DETAILED DESCRIPTION OF THE PREFERRED EMBODIMENT

Figure 1:
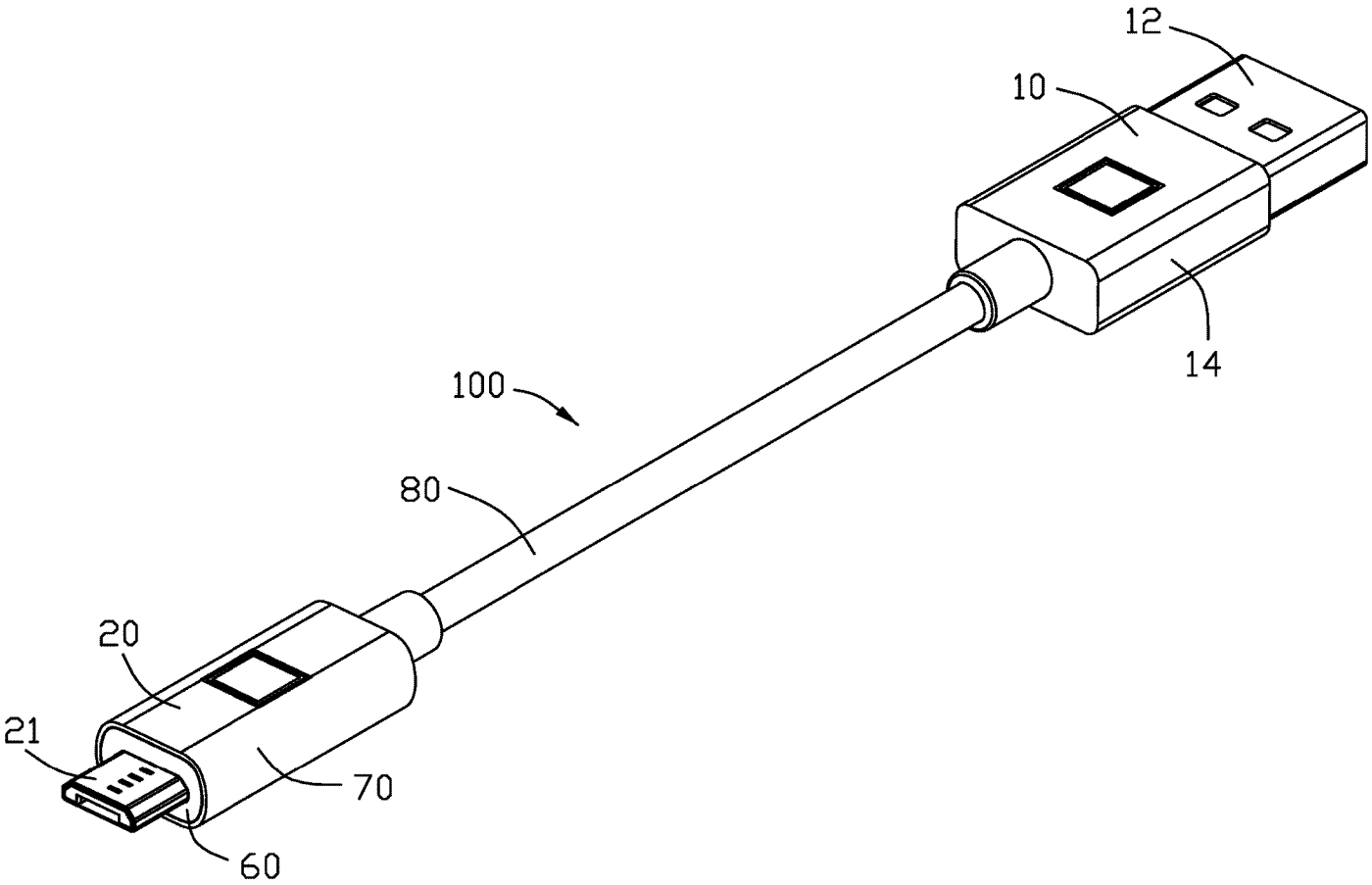
FIG. 1 is a perspective, assembled view of a cable connector assembly in accordance with the present invention.
Figure 2:
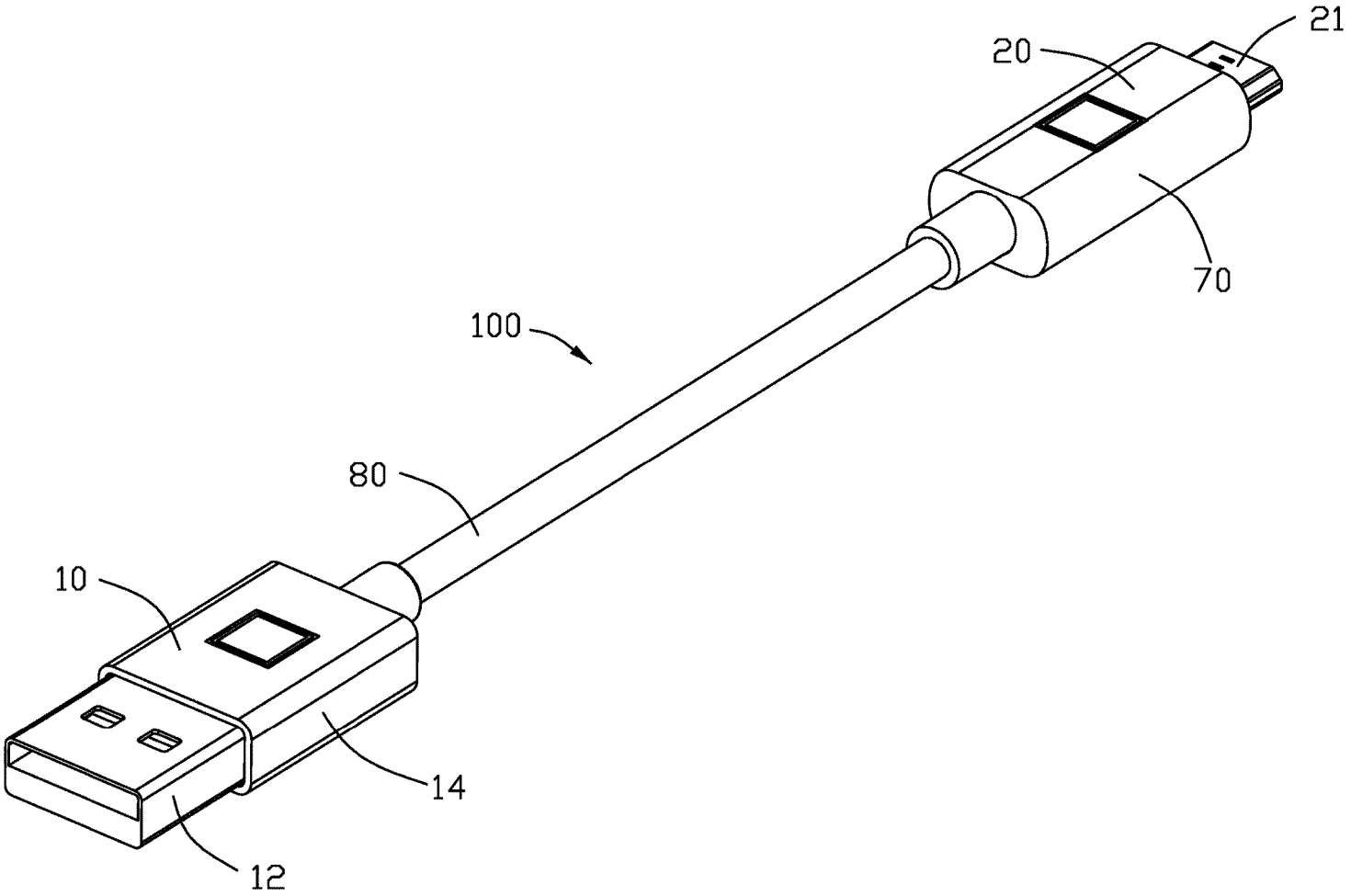
FIG. 2 is a view similar to FIG. 1, but viewed from another aspect.
Figure 3:
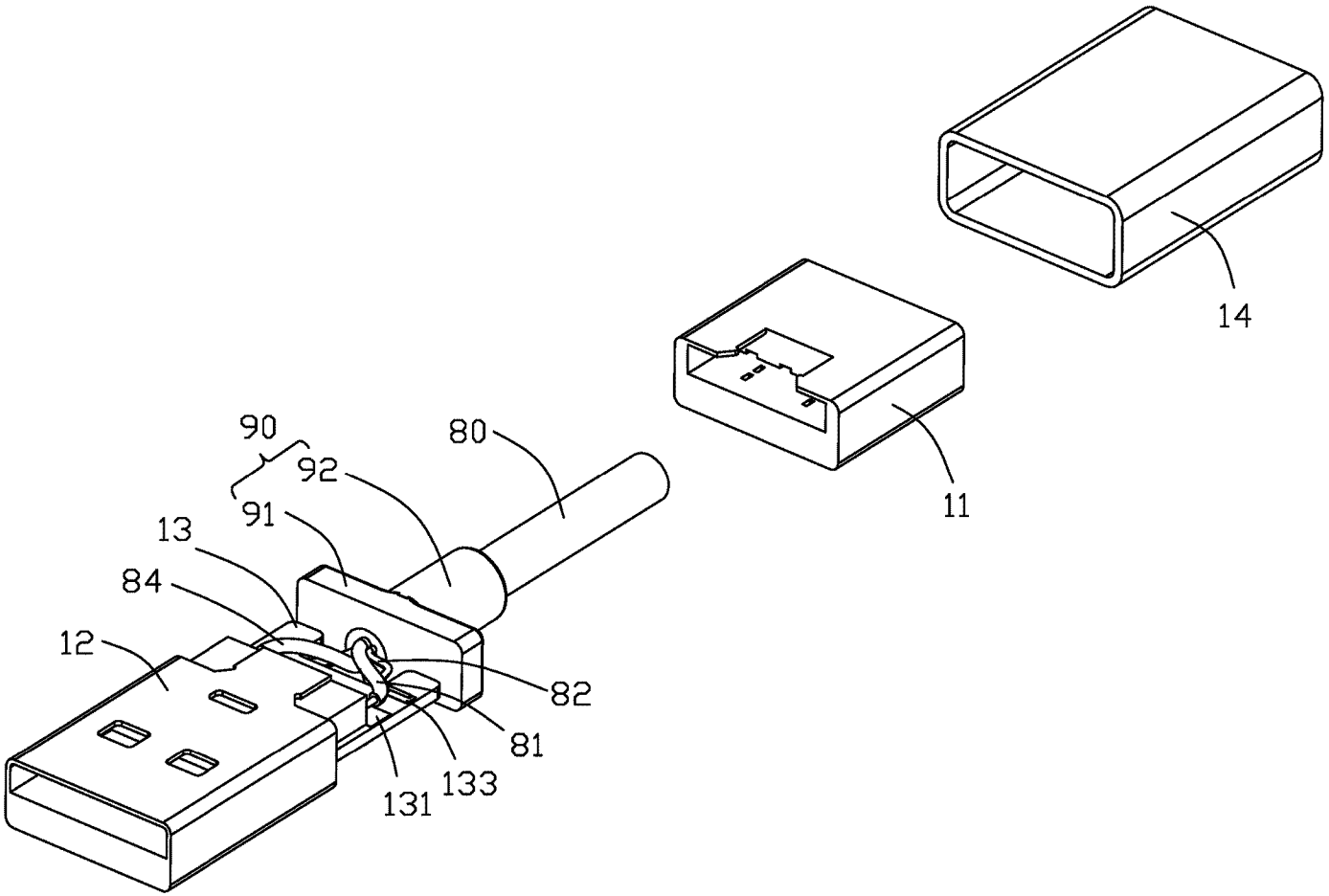
FIG. 3 is a partially exploded view of a first electrical connector of the cable connector assembly.
Figure 4:
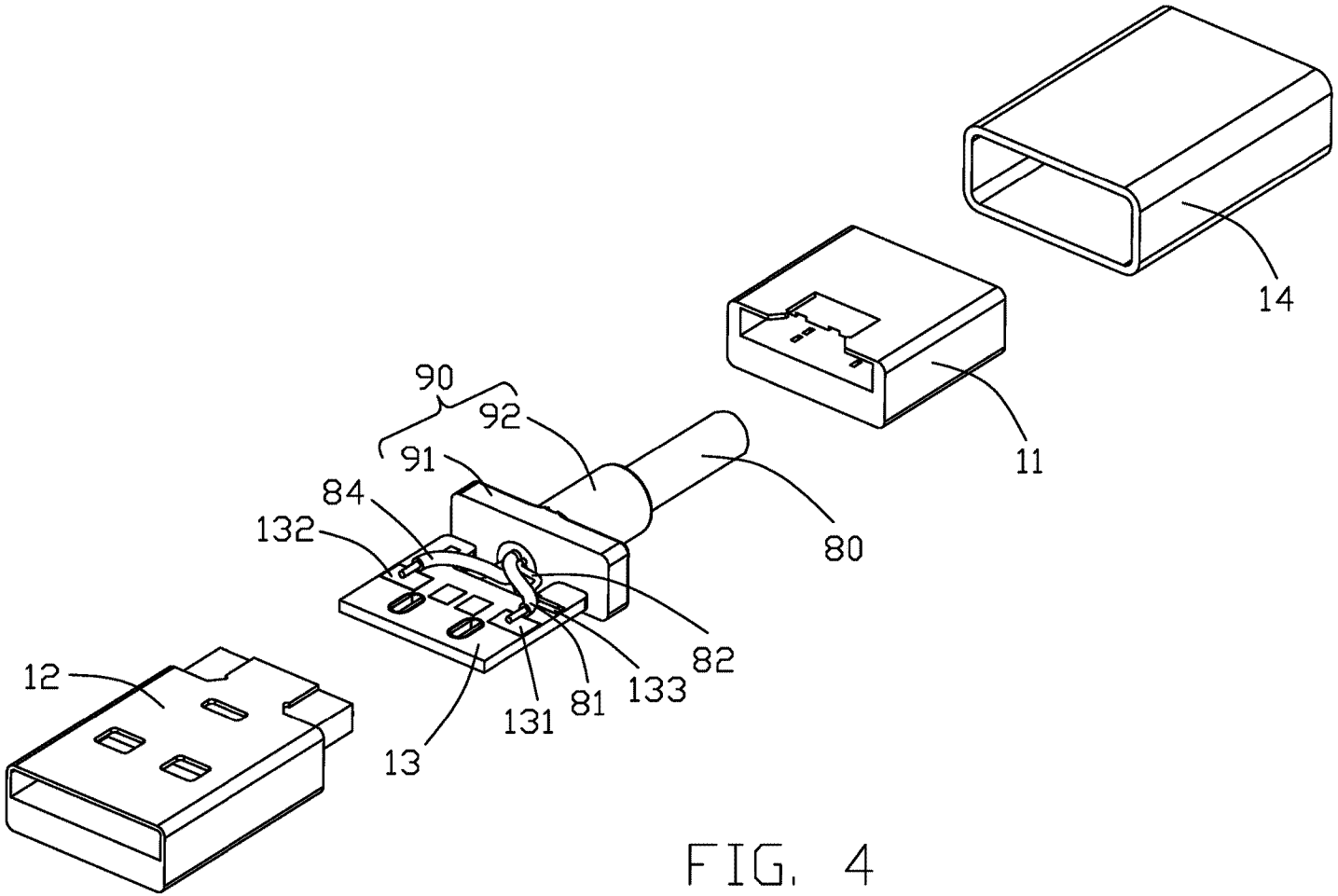
FIG. 4 is a further partially exploded view of the first electrical connector shown in FIG. 3.
Figure 5:
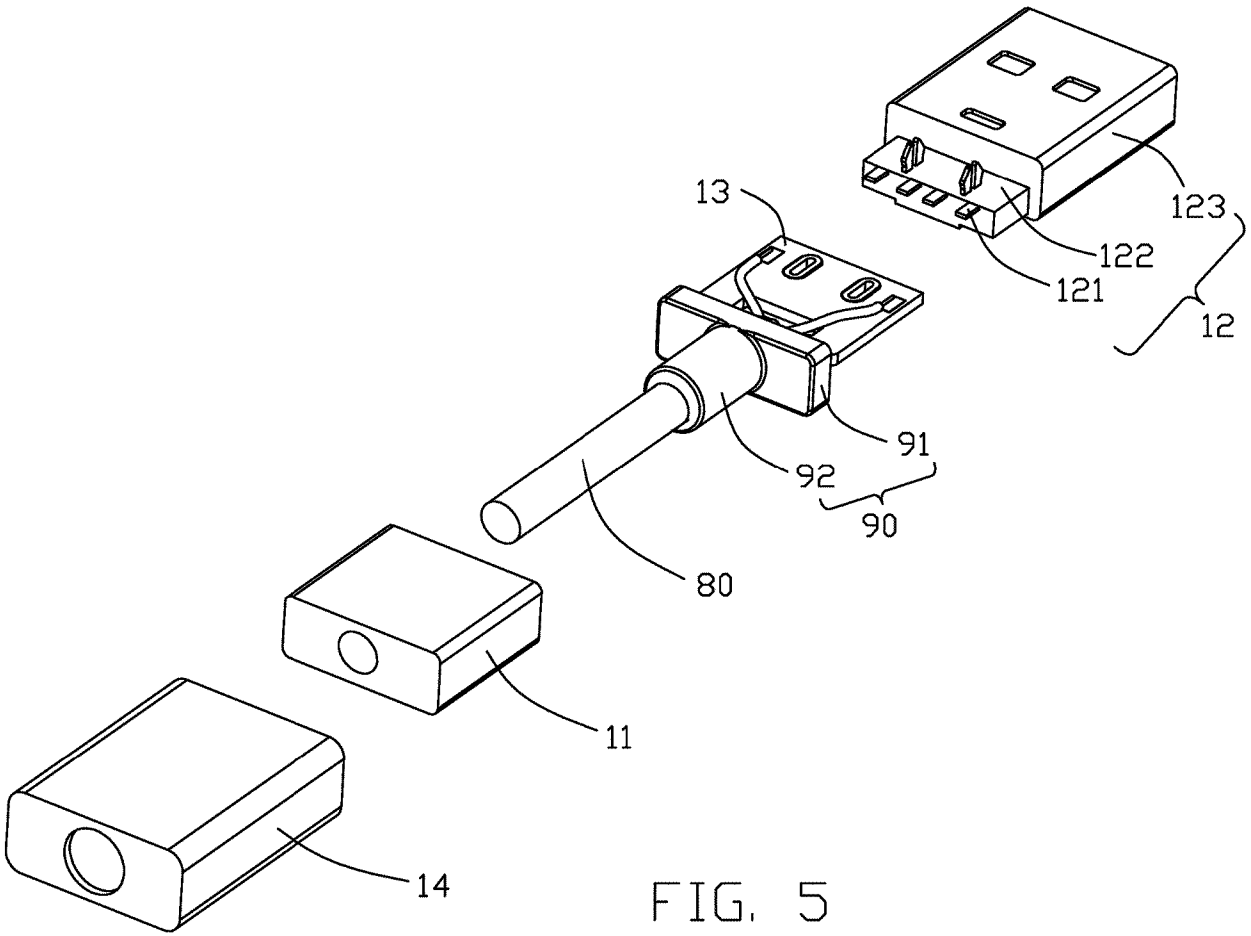
FIG. 5 is a view similar to FIG. 4, but viewed from another aspect.
Figure 6:
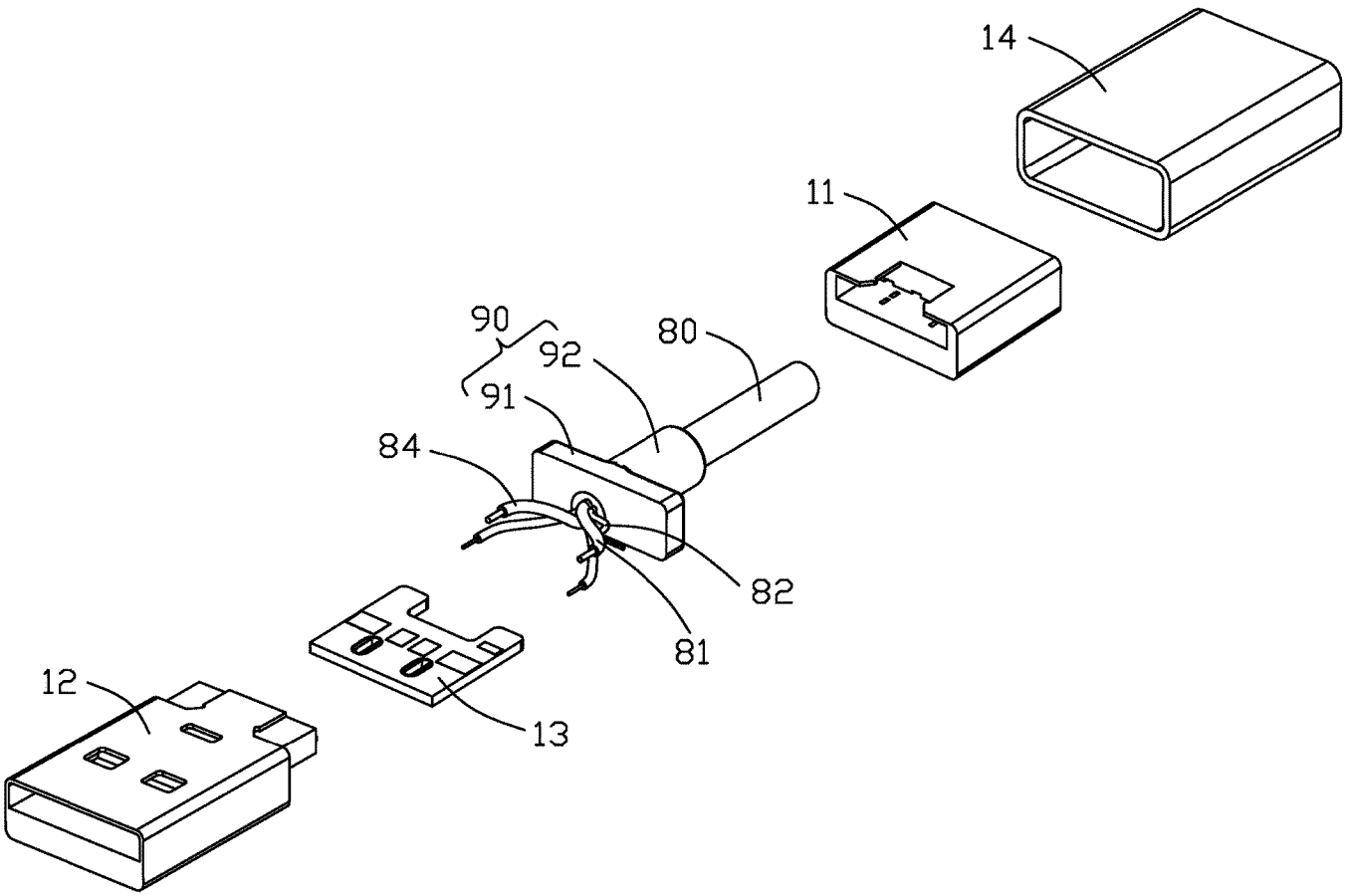
FIG. 6 is a further partially exploded view of the first electrical connector shown in FIG. 4.
Figure 7:
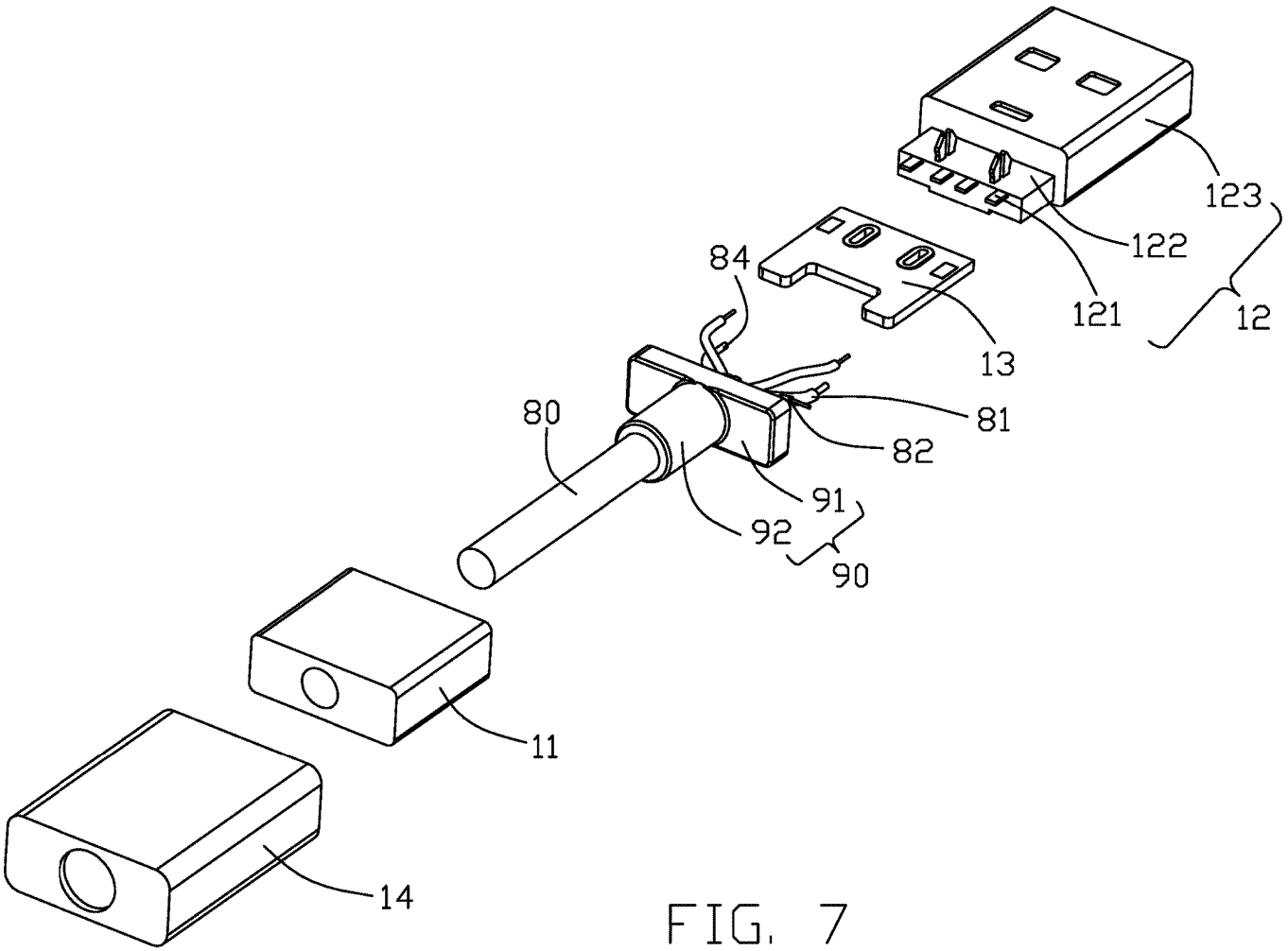
FIG. 7 is a similar to FIG. 6, but viewed from another aspect.
Figure 8:
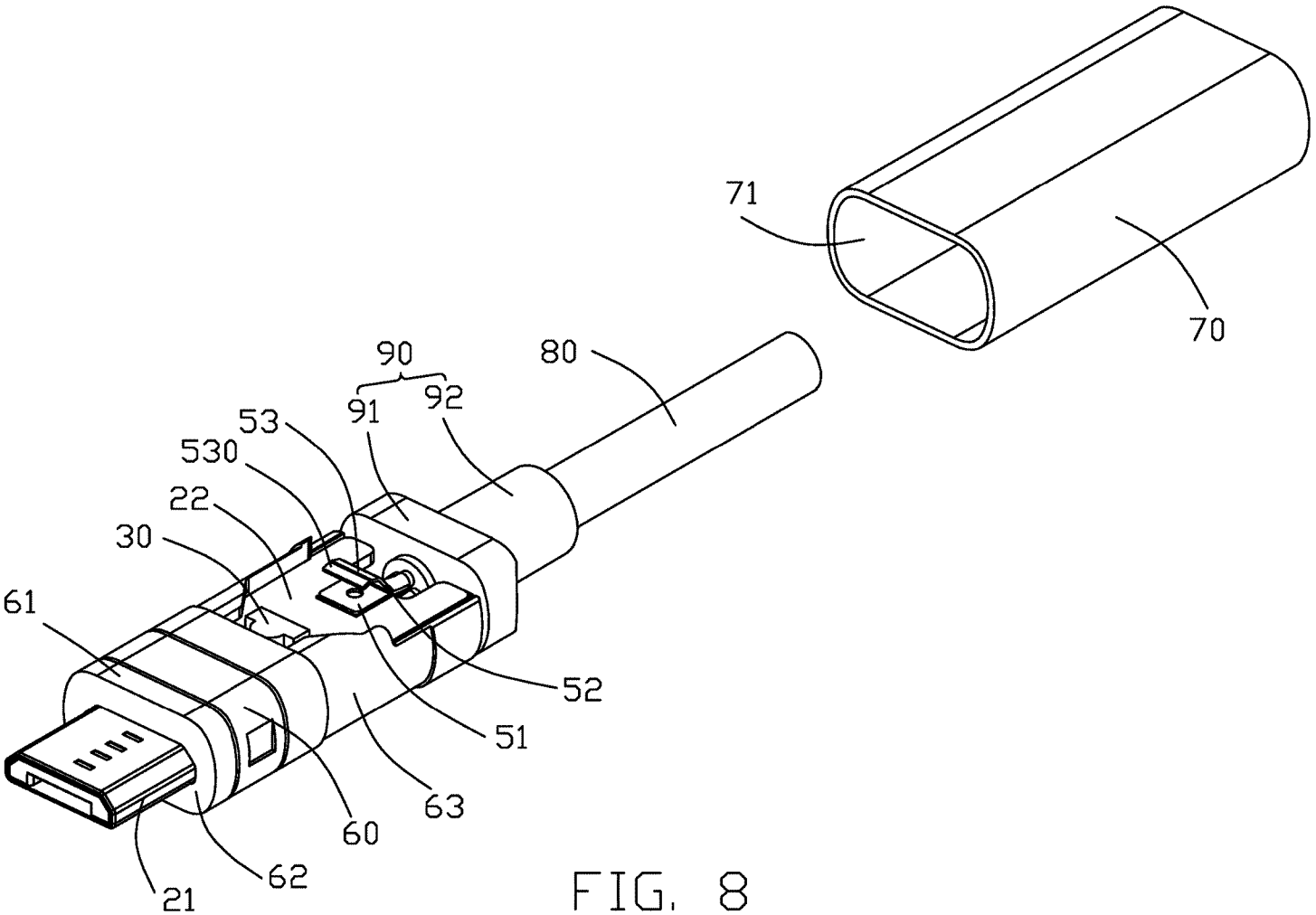
FIG. 8 is a partially exploded view of a second electrical connector of the cable connector assembly.
Figure 9:
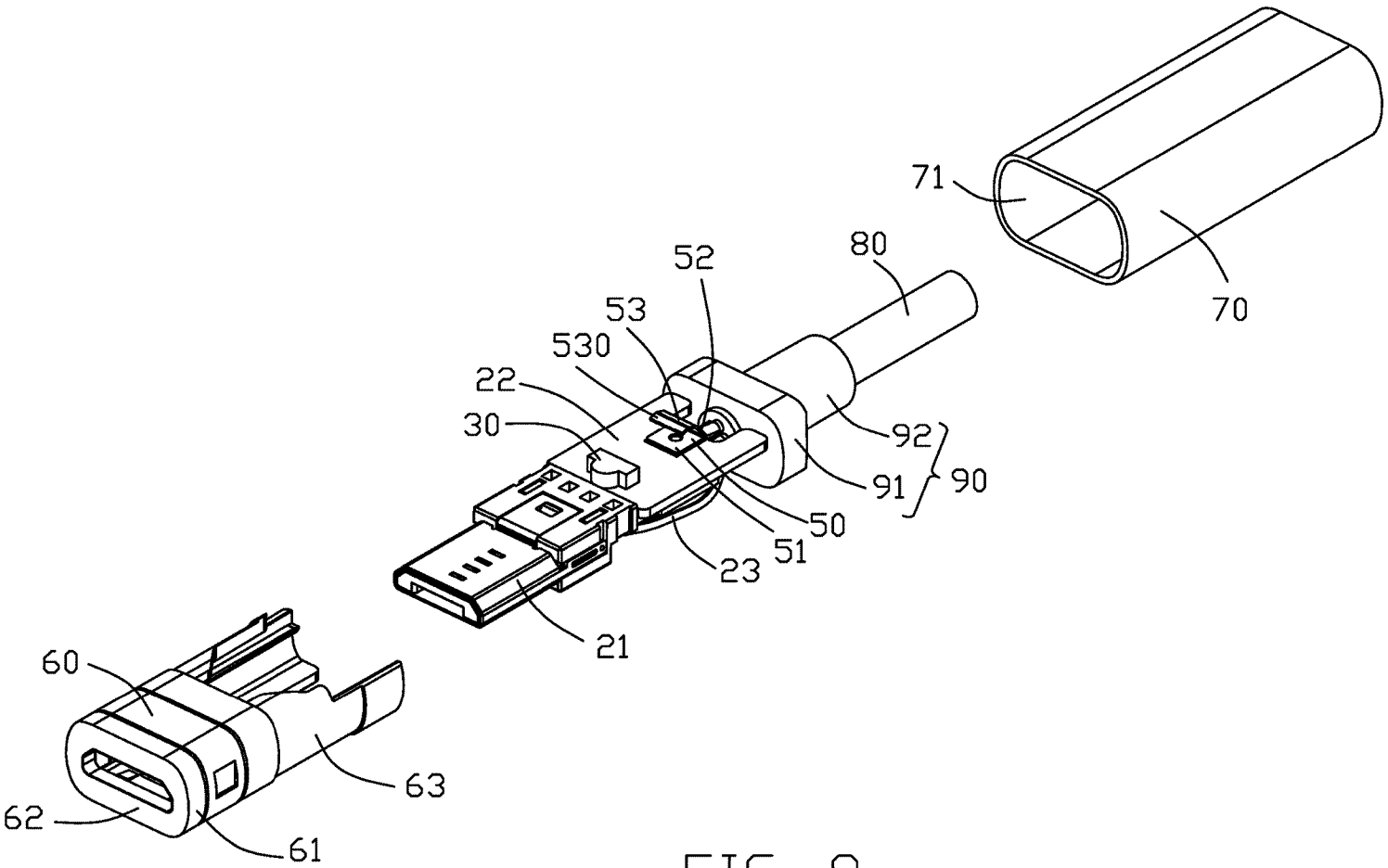
FIG. 9 is a further partially exploded view of the second electrical connector shown in FIG. 8.
Figure 10:
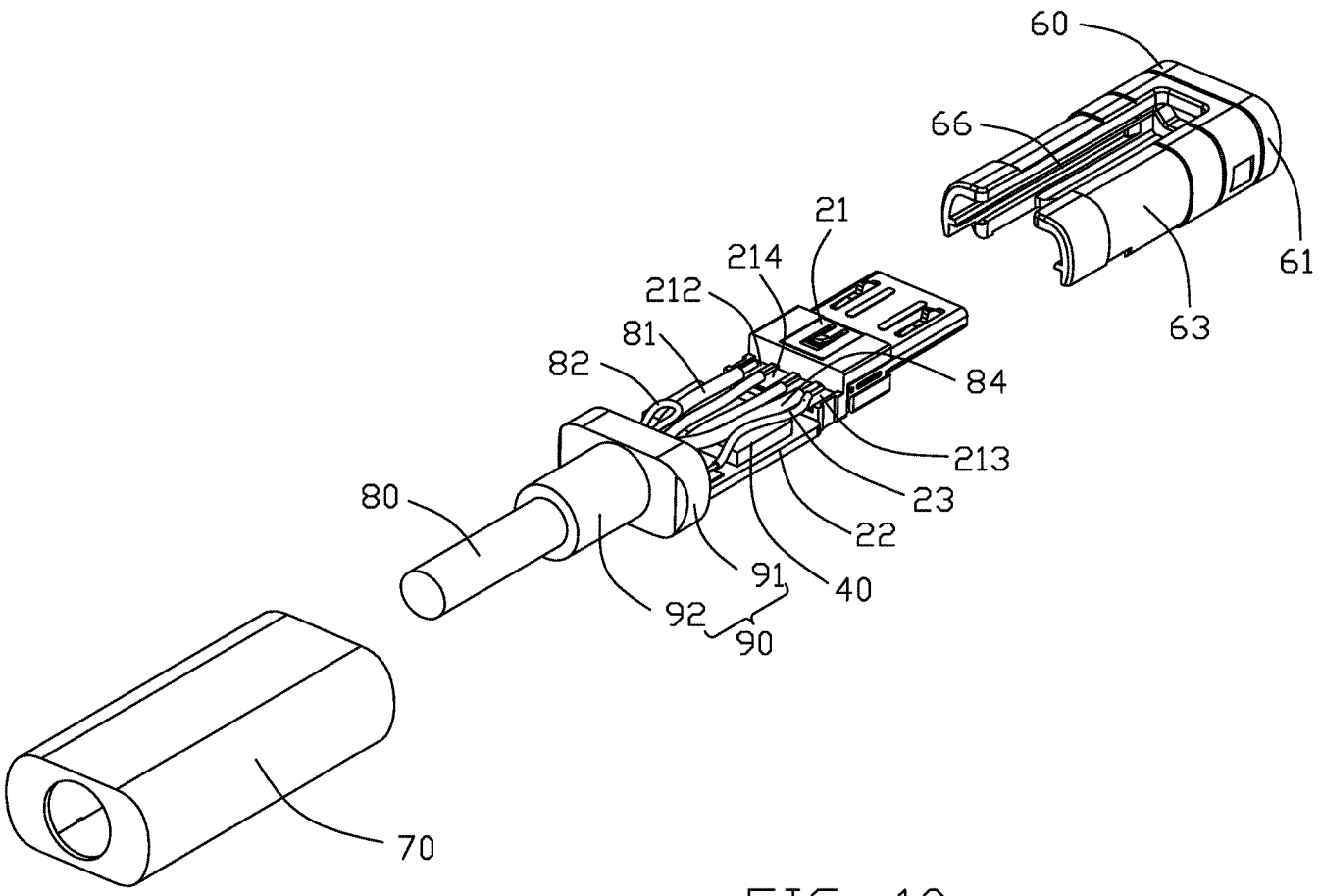
FIG. 10 is a view similar to FIG. 9, but viewed from another aspect.
Figure 11:
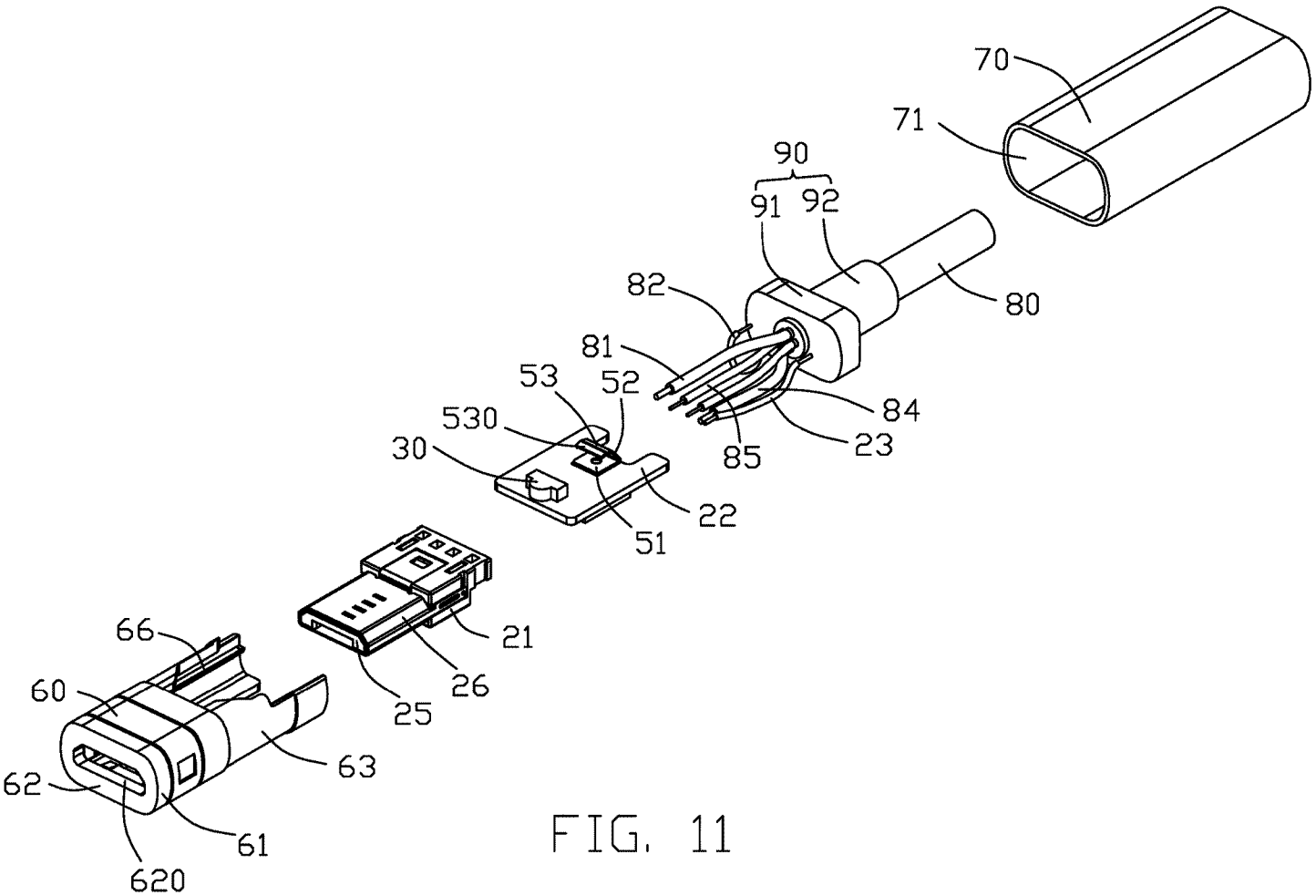
FIG. 11 is a further exploded view of the second electrical connector shown in FIG. 8.
Figure 12:
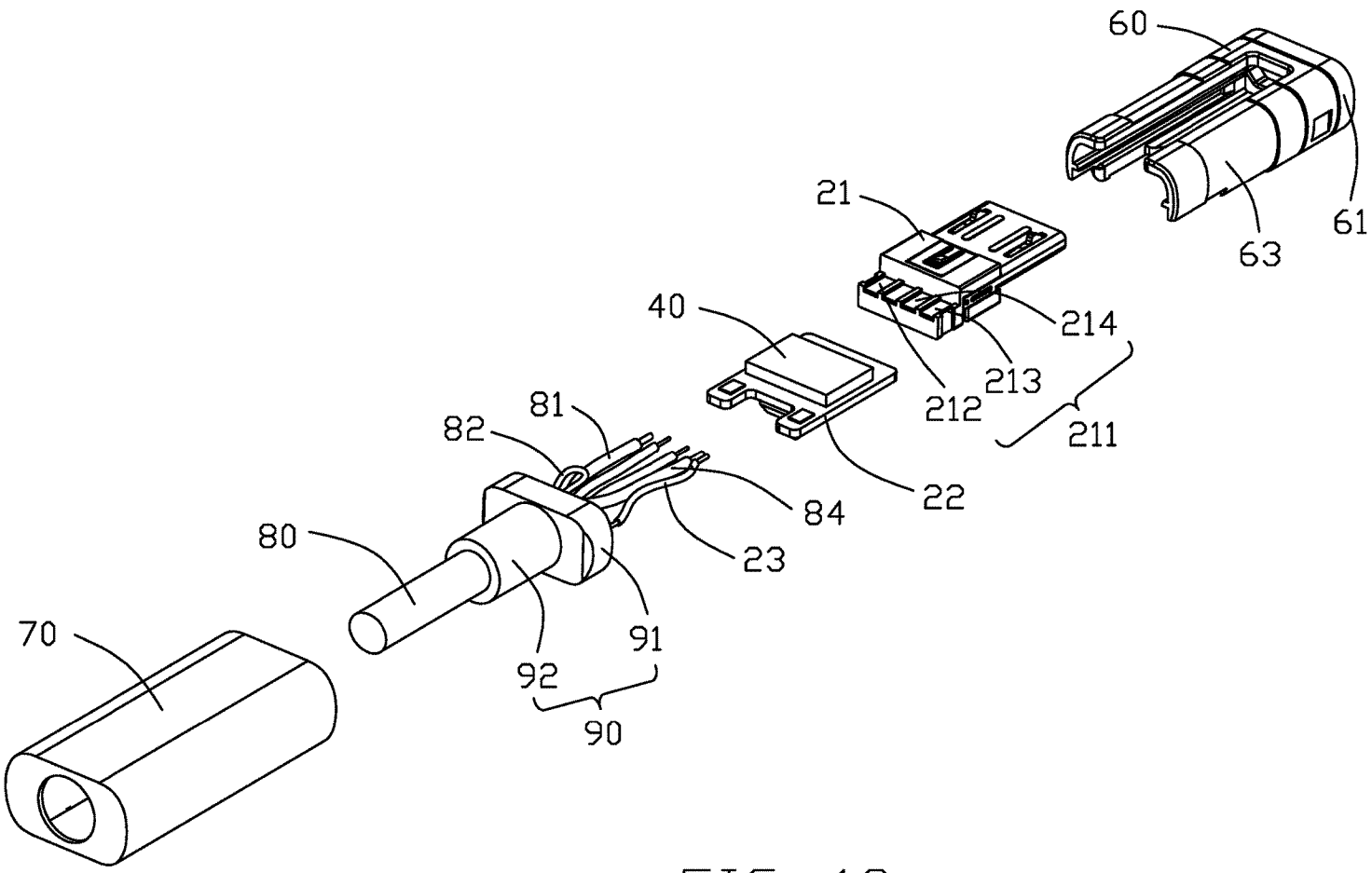
FIG. 12 is a view similar to FIG. 11, but viewed from another aspect.

Referring to FIGS. 1-2, the cable connector assembly 100 in accordance with the present invention comprises a first electrical connector 10, a second electrical connector 20 and a cable 80 connecting the first electrical connector 10 and the second electrical connector 20. In the embodiment of the present invention, the cable connector assembly 100 can charge or transfer signal for an electrical product (not shown). In another embodiment of the present invention, the cable connector assembly also can achieve another function.

Referring to FIGS. 3-7, the first electrical connector 10 comprises a frontal first mating member 12, a first printed circuit board 13 connected with the cable 80 electrically, an inner insulator 11 covering a front end of the cable 80 and a rear end of the mating member 12, and a first cover 14 covering the inner insulator 11. The first mating member 12 comprises a first insulative housing 122, a plurality of first contacts 121 accommodated in the first insulative housing 122 and a first shell 123 enclosing the insulative housing 122.

Referring to FIGS. 8-12, the second electrical connector 20 comprises a frontal second mating member 21, a second printed circuit board 22 connected with the cable 80, a light source 30 positioned on the second printed circuit board 22, a detector 40 assembled on the second printed circuit board 22, a light transmissive member 60 permitting a light emitted from the light source 30 to pass through, a detective member 50 associated with the detector 40 and a second cover 70 defining a space 71 for enclosing the light transmissive member 60. The detective member 50 resists against the second cover 70. The detector 40 controls the light source 30 to turn on or to turn off through the detective member 50 detecting a capacitance value on the second cover 70. The second mating member 21 comprises a second insulative housing 25, a plurality of second contacts 211 accommodated in the second insulative housing 25 and a shielding shell 26 enclosing the second insulative housing 25. The second contacts 211 comprise a power contact 212, a grounding contact 213 and a plurality of signal contacts 214. In the embodiment of the present invention, the second cover 70 is a metal shell. In another embodiment, the second cover 70 can be an insulative cover.

The detective member 50 comprises a fixed section 51 fasten on the second printed circuit board 22, a mating section 53 resisting against the second cover 70, a gradient section 530 extending downwardly from the mating section 53 and a connecting section 52 connecting the fixed section 51 and the mating section 53. In the embodiment of the present invention, the fixed section 51 is soldered to the second printed circuit board 22 and connected with the detector 40 electrically. The gradient section 530 is corresponded with the connecting section 52 for enhancing a strength of the mating section 53 and the connecting section 52 is elastic for resisting against the second cover 70 closely. The mating section 53 is parallel to the fixed section 51. The gradient section 530 and the connecting section 52 are symmetrical approximately.

The first printed circuit board 13 comprises a voltage regulator (not numbered) formed therein for regulating a voltage through the first electrical connector 10. The first electrical connector 10 can output two different voltages. When inputting a first voltage to the first printed circuit board 13, two different voltages are simultaneously outputted, and one is the first voltage (not shown) and the other one is a second voltage (not shown) changed by the voltage regulator. The first electrical connector 10 comprises an first voltage point 131 outputting the first voltage, an second voltage point 133 outputting the second voltage and a grounding point 132. In the embodiment of the present invention, the first voltage is larger than the second voltage, the first voltage 131 is a high voltage point outputting a high voltage, the second voltage 133 is a low voltage point outputting a low voltage. For example, the first voltage is larger than five volts for charging at high speed, the second voltage is changed to be five volts by the voltage regulator for protecting the light source 30 and the detector 40 to work correctly. The first voltage can be nine volts or twelve volts. In another embodiment, the second voltage can be larger than the first voltage for achieving another function.

The light transmissive member 60 comprises a penetrable portion 61 through which the light penetrates, a positioning portion 63 extending rearwardly from the penetrable portion 61 and a receiving space 66 surrounded by the penetrable portion 61 and the positioning portion 63. The penetrable portion 61 comprises a penetrable section 62 located in a front end thereof and exposed out of a front end of the second cover 70. The penetrable section 62 defines an opening 620 through which the second mating member 21 passes. The opening 620 connects with the receiving space 66.

The cable 80 comprises a strain relief 90 and a plurality wires (not numbered). The strain relief 90 comprises a resisting section 91 and a holding section 92. The plurality of wires comprise a first wire 81 transferring the first voltage, a second wire 82 transferring the second voltage, a third wire 23, a fourth wire 84 and a plurality of main wires 85. The first voltage point 131 and the power contact 212 are connected electrically through the first wire 81. The second voltage point 133 and the second printed circuit board 22 are connected electrically through the second wire 82. The second printed circuit board 22 and the grounding contact 213 are connected electrically through the third wire 23. The grounding point 132 and the grounding contact 213 are connected electrically through the fourth wire 84. The main wires 85 is connected with the signal contacts 214.

In another embodiment, the first printed circuit board 13 comprises a safety switch (not shown) detecting an actual voltage value and an actual current value of the first voltage point 131 and the second voltage point 133 to control an electrical connection among the first printed circuit board 13, the second printed circuit board 22 and the second mating member 21. When detecting the actual voltage value is larger than a rated voltage value or the actual current value is larger than a rated current value, the corresponding electrical connection would be cut off.

In another embodiment, the second electrical connector 20 comprises a first power point and a second power point for providing two different powers therein. The first voltage point 131 and the first power point are connected electrically for providing a first power. The second voltage 133 and the second power point are connected electrically for providing a second power. For example, the first power point provides the first power to charging at high speed, and the second power provides the second power to light.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable connector assembly comprising:

a first electrical connector comprising a frontal first mating member for inputting a first voltage, a first voltage point for outputting the first voltage, and a second voltage point for outputting a second voltage lower than the first voltage;

a second electrical connector comprising a frontal second mating member and a second printed circuit board, the second mating member comprising a power contact; and a cable connecting the first electrical connector and the second electrical connector electrically, the cable comprising a first wire and a second wire, the first wire connecting the first voltage point and the power contact electrically, the second wire connecting the second voltage point and the second printed circuit board electrically; wherein the first electrical connector further comprises a voltage regulator formed therein for passing the first voltage to provide the second voltage;

the first electrical connector comprises a first printed circuit board connected with the cable, the voltage regulator is formed in the first printed circuit board, and the first voltage point and the second voltage point are defined on the first printed circuit board;

the first printed circuit board comprises a grounding point, the second mating member further comprises a grounding contact, the cable further comprises a third wire and a fourth wire, the third wire electrically connects the second printed circuit board and the grounding contact, and the fourth wire electrically connects the grounding point and the grounding contact;

the second electrical connector comprises a light source positioned on the the first voltage point outputs a high voltage for charging, and the second voltage point outputs a low voltage for providing a power to the light source.

2. The cable connector assembly as claimed in claim 1, wherein the first electrical connector further comprises a first cover enclosing the first printed circuit board and a rear end of the first mating member.

3. The cable connector assembly as claimed in claim 1, wherein the second electrical connector further comprises a light transmissive member for passing a light emitted from the light source and a second cover enclosing the second printed circuit board and the light transmissive member.

4. The cable connector assembly as claimed in claim 3, wherein the second electrical connector further comprises a detector and a detective member assembled on the second printed circuit board, and the detector controls the light source through the detective member detecting a capacitance value on the second cover.

5. The cable connector assembly as claimed in claim 4, wherein the second cover is a metal shell, and the detective member resists against the second cover for detecting the capacitance value thereon.

6. The cable connector assembly as claimed in claim 1, wherein the first electrical connector comprises a safety switch detecting an actual voltage value or an actual current value of the first voltage point and the second voltage point to control an electrical connection between the first voltage point and the second mating member and to control another electrical connection between the second voltage point and the second printed circuit board.

7. A cable connector assembly for charging, comprising:

a first electrical connector including a frontal first mating member configured for inputting a first voltage, a first printed circuit board with a first voltage point thereon for outputting the first voltage, and a second voltage point thereon for outputting a second voltage smaller than the first voltage;

a second electrical connector including a frontal second mating member and a second printed circuit board, the second mating member including a power contact; and a cable mechanically and electrically connected between the first electrical connector and the second electrical connector, the cable including a first wire and a second wire, the first wire connecting the first voltage point and the power contact electrically, the second wire connecting the second voltage point and the second printed circuit board electrically; wherein the first printed circuit board is equipped with a voltage regulator to convert the first voltage to the second voltage, and the first connector simultaneously outputs both said first voltage and said second voltage to the second connector.

8. The cable connector assembly as claimed in claim 7, wherein the first printed circuit board further includes a grounding point, the second mating member further includes a grounding contact, the cable further includes a third wire and a fourth wire, the third wire electrically connects the second printed circuit board and the grounding contact, and the fourth wire electrically connects the grounding point and the grounding contact.

9. The cable connector assembly as claimed in claim 7, wherein the second electrical connector further includes a light source positioned on the second printed circuit board, and a light transmissive member for passing a light emitted from the light source.

10. The cable connector assembly as claimed in claim 9, wherein the light source is activated by the second voltage.

11. The cable connector assembly as claimed in claim 10, wherein the second electrical connector further includes a detector and a detective member assembled on the second printed circuit board, and the detector controls the light source through the detective member detecting a capacitance value on a cover which covers the second printed circuit board and the light transmissive member.

12. The cable connector assembly as claimed in claim 11, wherein the second cover is a metal shell, and the detective member resists against the second cover for detecting the capacitance value thereon.

13. The cable connector assembly as claimed in claim 7, wherein the first electrical connector includes a safety switch detecting an actual voltage value or an actual current value of the first voltage point and the second voltage point to control an electrical connection between the first voltage point and the second mating member and to control another electrical connection between the second voltage point and the second printed circuit board.

14. The cable connector assembly as claimed in claim 7, wherein said power contact is directly connected to the first wire.

15. A cable connector assembly for charging, comprising:

a first electrical connector including a frontal first mating member configured for inputting only a first voltage;

a second electrical connector including a frontal second mating member, the second mating member including a power contact transmitting the first voltage; and a cable mechanically and electrically connected between the first electrical connector and the second electrical connector;

a first printed circuit board on which a voltage regulator is mounted to change the first voltage to a second voltage smaller than the first voltage; and a second printed circuit board, on which a light source is mounted, being disposed in the second connector;

both said first voltage and said second voltage being simultaneously applied upon the second connector, wherein the power contact transports the first voltage while the light source is activated by the second voltage.

16. The cable connector assembly as claimed in claim 15, wherein the first printed circuit board is discrete from the second printed circuit board and disposed in the first connector.

17. The cable connector assembly as claimed in claim 16, wherein a first wire of the cable is directly mechanically and electrically connected between a first voltage point formed on the first printed circuit board and the power contact to transport the first voltage.

18. The cable connector assembly as claimed in claim 17, wherein a second wire of the cable is directly mechanically and electrically connected between a second voltage point formed on the first printed circuit board and the second printed circuit board.

* * * * *